US005605618A

United States Patent [19]

Maeda et al.

[11] Patent Number: 5,605,618

[45] Date of Patent: Feb. 25, 1997

[54] PROCESS FOR PREPARING NITROGEN-CONTAINING ISOTROPIC PITCH AND NITROGEN-CONTAINING ISOTROPIC PITCH

[75] Inventors: Takashi Maeda; Tomiji Hosotsubo, both of Kamisu, Japan

[73] Assignee: Petoca, Ltd., Tokyo, Japan

[21] Appl. No.: 524,847

[22] Filed: Sep. 7, 1995

[30] Foreign Application Priority Data

Sep. 9, 1994 [JP] Japan ..... 6-240757
Sep. 9, 1994 [JP] Japan ..... 6-240758

[51] Int. Cl.[6] ..... C10C 30/06

[52] U.S. Cl. ..... 208/39; 208/40; 208/41; 208/44; 208/424; 208/428; 208/370

[58] Field of Search ..... 208/39, 40, 41, 208/44, 424, 428, 370

[56] References Cited

U.S. PATENT DOCUMENTS

| | | | |
|---|---|---|---|
| 2,304,773 | 12/1942 | Anderton | 208/39 |
| 2,465,960 | 3/1949 | Van Den Berge | 208/39 |
| 2,683,107 | 7/1954 | Juel | 208/39 |
| 2,690,418 | 9/1954 | Young et al. | 208/39 |
| 2,944,958 | 7/1960 | Goldthwait et al. | 208/39 |
| 3,035,308 | 5/1962 | Ragoss et al. | 208/39 |
| 3,493,409 | 2/1970 | Koons | 208/44 |
| 3,775,289 | 11/1973 | Kishi et al. | 208/39 |
| 3,878,087 | 4/1975 | Kawai et al. | 208/40 |
| 4,014,781 | 3/1977 | Ueda | 208/40 |
| 4,026,788 | 5/1977 | McHenry | 208/40 |

FOREIGN PATENT DOCUMENTS

| | | |
|---|---|---|
| 5302217 | 11/1993 | Japan . |
| 6187988 | 7/1994 | Japan . |

*Primary Examiner*—Glenn A. Caldarola
*Assistant Examiner*—Patricia L. Hailey
*Attorney, Agent, or Firm*—Oblon, Spivak, McClelland, Maier & Neustadt, P.C.

[57] ABSTRACT

A process for preparing nitrogen-containing isotropic pitch, comprising the steps of mixing a petroleum heavy oil, a nitrating reagent and water to prepare a homogeneous dispersion, thereby contacting the petroleum heavy oil with the nitrating reagent in the homogeneous dispersion state to prepare a crude nitrated heavy oil, and subjecting the crude nitrated heavy oil to refining, thermal polymerization and vacuum distillation. According to the process of the invention, a petroleum heavy oil containing a large amount of light oil components and being liquid at ordinary temperature, from which pitch has been hardly prepared conventionally, is used as a starting material for preparing pitch, and there can be obtained nitrogen-containing isotropic pitch of homogeneity and high quality having a desired softening point of from a low softening point to a high softening point, though such pitch was unable to be obtained so far.

7 Claims, No Drawings

PROCESS FOR PREPARING NITROGEN-CONTAINING ISOTROPIC PITCH AND NITROGEN-CONTAINING ISOTROPIC PITCH

FIELD OF THE INVENTION

The present invention relates to a process for preparing nitrogen-containing isotropic pitch from a petroleum heavy oil, said pitch being useful for the preparation of various carbon materials and useful for the impregnation into porous carbon materials, and to nitrogen-containing isotropic pitch which can be prepared by said process.

More particularly, the invention relates to a process for preparing nitrogen-containing isotropic pitch, by which nitrogen-containing isotropic pitch having a high softening point can be prepared in a high yield using a petroleum heavy oil containing a large amount of light oil components and being liquid at ordinary temperature, such heavy oil having been not a favorable starting material in the conventional processes. The invention also relates to nitrogen-containing isotropic pitch which can be favorably used for high-quality isotropic carbon materials, for example, not only for matrix of such as fiber-reinforced resin but also for preparing isotropic pitch based carbon fibers, activated carbon fibers (ACF), conductive carbon materials, etc.

BACKGROUND OF THE INVENTION

Isotropic pitches are used for preparing various isotropic carbon materials, for example, isotropic pitch based carbon fibers, activated carbon fibers (ACF) and conductive carbon materials.

The isotropic pitches have been conventionally prepared by processes in which petroleum heavy oils such as catalytically cracked (FCC) residual oils as starting materials are subjected to heat treatment or blowing method using oxygen or ozone.

In these processes for preparing pitch, however, if a petroleum heavy oil containing light oil components is used as a starting material, these light oil components are eliminated before the thermal polymerization reaction proceeds, and therefore the yield of pitch is very low. Especially when a heavy oil which contains a large amount of light oil components and which is liquid at ordinary temperature is used, the yield of pitch becomes extremely low, and preparation of pitch is practically impossible. On that account, the petroleum heavy oil containing a large amount of light oil components was unable to be used as a starting materiel of pitch for preparing carbon materials and such heavy oil has been conventionally used only as a heavy oil blending component.

It is known that the isotropic pitches are nitrated before carbonizing or graphitizing them in the preparation of carbon materials. Japanese Patent Laid-Open Publication No. 302217/1993 discloses technique relating to a process for preparing low-viscosity pitch for matrix, comprising the steps of spinning ordinary isotropic pitch to form fibrous pitch and nitrating the fibrous pitch in a solid-liquid phase.

In this technique, however, the starting pitch is made fibrous by spinning and the nitration reaction is carried out in the solid-liquid phase in order to conduct an uniform nitration, that is, a procedure of spinning the starting pitch to make it fibrous is necessary, and therefore the process is complicated.

Further, the pitch for matrix obtained by this process has a low softening point and a low viscosity, so that this pitch cannot be applied, as it is, to uses other than the use for matrix, in which a high softening point is required.

For raising the softening point, there is known a method of heat-treating low-viscosity pitch having been subjected to nitration reaction, so as to polymerize the pitch. In the nitration reaction in the solid-liquid phase in the conventional process, however, there is limitation on the degree of nitration, and hence isotropic pitch sufficiently nitrated cannot be obtained. If the isotropic pitch thus insufficiently nitrated is heat-treated, polymerization reaction does not satisfactorily proceed and isotropic pitch having a desired softening point cannot be obtained.

The present inventors have earnestly studied in view of such circumstances of the prior art as mentioned above, and they have found that, by a process comprising the steps of mixing a petroleum heavy oil, particularly a petroleum heavy oil containing a large amount of light oil components, with a nitrating reagent and water to give a homogeneous dispersion, nitrating the heavy oil in the homogeneous dispersion state, then refining the nitrated heavy oil and thermally polymerizing the heavy oil, a petroleum heavy oil can be uniformly nitrated and polymerized with inhibiting elimination of the light oil component. The present inventors have made further improvement and accomplished the present invention.

OBJECT OF THE INVENTION

The present invention is intended to solve such problems associated with the prior art as described above, and it is an object of the invention to provide a process for preparing nitrogen-containing isotropic pitch by which a petroleum heavy oil containing a large amount of light oil components and being liquid at ordinary temperature can be efficiently and uniformly nitrated and isotropic pitch having a sufficiently high softening point can be obtained.

It is another object of the invention to provide nitrogen-containing pitch from which high-quality isotropic carbon materials, e.g., isotropic pitch based carbon fibers, activated carbon fibers (ACF) and conductive carbon materials can be prepared.

SUMMARY OF THE INVENTION

The process for preparing nitrogen-containing isotropic pitch according to the present invention comprises the steps of mixing a petroleum heavy oil, a nitrating reagent and water to prepare a homogeneous dispersion, contacting the petroleum heavy oil with the nitrating reagent in the homogeneous dispersion state to obtain a crude nitrated heavy oil, removing water and the unreacted nitrating reagent contained in the crude nitrated heavy oil to prepare a refined nitrated heavy oil, heating the refined nitrated heavy oil to polymerize it so as to prepare crude nitrogen-containing isotropic pitch, and subjecting the crude nitrogen-containing isotropic pitch to vacuum distillation to remove light components, thereby adjusting a softening point, a residual carbon ratio, etc. of the nitrogen-containing isotropic pitch.

In the process for preparing nitrogen-containing isotropic pitch according to the invention, the petroleum heavy oil desirably has an aromatic carbon ratio fa of not more than 0.8, preferably 0.8 to 0.4, contains a large amount of light oil components and is liquid at ordinary temperature.

In the process of the invention, the nitrating reagent constitutes an aqueous solution with water contained in the homogeneous dispersion, and the reagent is desirably contained in the aqueous solution in an amount of 15 to 60% by weight, preferably 30 to 50% by weight. An example of the nitrating reagent is at least one compound selected from the group consisting of nitric acid, organic nitric acid esters and nitrous acid.

The nitrogen-containing isotropic pitch according to the invention has a quinoline-insoluble content (QI) of substantially zero, a toluene-insoluble content (TI) of 30 to 70% by weight, preferably 40 to 60% by weight, a softening point, as measured by Mettler (ASTM D-3104), of 160° to 350° C., a residual carbon ratio, as measured by thermogravimetric analysis (TG) at 800° C. in inert atmosphere, of not less than 50% by weight, preferably 60 to 80% by weight, and a nitrogen content, as measured by elemental analysis, of 0.5 to 3.5% by weight, preferably 1.0 to 3.0% by weight.

In the process for preparing nitrogen-containing isotropic pitch according to the invention, after the petroleum heavy oil is nitrated in the liquid-liquid phase in the homogeneous dispersion state, the nitrated heavy oil is subjected to refining treatment, heat treatment and vacuum distillation in this order. Hence, a petroleum heavy oil containing a large amount of light oil components and being liquid at ordinary temperature can be efficiently and uniformly nitrated, and moreover nitrogen-containing isotropic pitch having a sufficiently high softening point can be obtained. In addition, the conditions for the vacuum distillation of the final treatment can be optionally determined so that the desired softening point is obtained, and hence there can be obtained nitrogen-containing pitch having any softening point of from a low softening point to a high softening point according to the type of the aimed carbon material.

The nitrogen-containing isotropic pitch according to the invention has the aforementioned QI value and nitrogen content, that is, the nitration has been carried out uniformly and thoroughly in the preparation thereof, and therefore the pitch has homogeneous properties. Further, because of the aforementioned softening point, TI value and residual carbon ratio, the nitrogen-containing isotropic pitch of the invention is a pitch of high quality having been homogeneously polymerized.

Furthermore, the nitrogen-containing isotropic pitch obtained by the process of the invention has a softening point (measured by Mettler (ASTM D-3104)) of wide range, i.e., 160° to 350° C., and hence it can be favorably used not only as pitch for matrix, having a low softening point of 160° to 200° C. but also as pitch for carbon material, having an intermediate softening point of 160° to 300° C. and pitch for activated carbon fibers or carbon fibers, having a relatively high softening point of 200° to 350° C.

DETAILED DESCRIPTION OF THE INVENTION

I. Process for preparing nitrogen-containing isotropic pitch

In the process for preparing nitrogen-containing isotropic pitch according to the invention, (i) a petroleum heavy oil is nitrated in a homogeneous dispersion obtained by mixing the petroleum heavy oil with a nitrating reagent and water, to prepare a crude nitrated heavy oil; (ii) specific impurities are removed from the crude nitrated heavy oil to prepare a refined nitrated heavy oil; (iii) the refined nitrated heavy oil is thermally polymerized to prepare crude nitrogen-containing isotropic pitch; and (iv) the crude nitrogen-containing isotropic pitch is vacuum distilled to prepare nitrogen-containing isotropic pitch.

Hereinafter, these steps in the process for preparing a nitrogen-containing isotropic pitch of the present invention will be detailed.

(i) Nitration treatment

In the process for preparing nitrogen-containing isotropic pitch according to the invention, a homogeneous dispersion containing a petroleum heavy oil, a nitrating reagent and water is first prepared and the petroleum heavy oil is nitrated in the homogeneous dispersion state.

The petroleum heavy oil used in the present invention may be any one of petroleum heavy oils include distillation residual oil, hydrogenation decomposition residual oil and catalytically cracked residual oil from crude oils, vacuum distillation products of these residual oils, and heat treatment products of these residual oils. There is no specific limitation on the petroleum heavy oil as far as they can be mixed with water and a nitrating reagent to form a homogeneous dispersion.

Specifically, the petroleum heavy oil used in the process of the invention desirably has an aromatic carbon ratio fa of not more than 0.8, preferably 0.7 to 0.4.

The aromatic carbon ratio fa of the heavy oil is represented by the following formula:

$$fa = \frac{\text{Number of aromatic carbon atoms in oil or pitch}}{\text{Number of all carbon atoms in oil or pitch}}$$

The fa value in the above formula can be determined by measuring $^{13}$C-NMR of the petroleum heavy oil.

If the fa value of the petroleum heavy oil used in the invention exceeds 0.8, the amounts of the aliphatic hydrocarbons and the like having high reactivity to the nitrating reagent are reduced, whereby the reaction efficiency tends to be lowered and a long period of time may be required for the nitration treatment.

The process of the invention has technical significance in that this process can be effectively applied to petroleum heavy oils containing light oil components, which have been conventionally hardly used as starting materials for pitches, such as FCC residual oils and their light oil fractions.

In detail, the petroleum heavy oil preferably used in the invention is liquid at ordinary temperature and has a viscosity, as measured at 50° C. by a capillary method of JIS K-2283 (Ostwald Cannon-Fenske), of not more than 500 cst, preferably 10 to 300 cst. When the petroleum heavy oil, which is liquid at ordinary temperature, is mixed with water and a nitrating reagent with or without adding an emulsifying agent, the heavy oil is easily homogeneously emulsified or dispersed to give a homogeneous dispersion. Consequently, the petroleum heavy oil can be homogeneously and thoroughly nitrated in the homogeneous dispersion state, so that through the subsequent given treatments, nitrogen-containing isotropic pitch particularly having a high softening point can be obtained. If the viscosity of the petroleum heavy oil exceeds 500 cst, it may become difficult to emulsify or homogeneously disperse the petroleum heavy oil by mixing it with a nitrating reagent, and it may be hard to effectively nitrate the petroleum heavy oil.

Examples of the nitrating reagents which are mixed with the petroleum heavy oil and water to form a homogeneous dispersion include nitric acid; organic nitric acid esters such as methyl nitrate, ethyl nitrate and propyl nitrate; and nitrous acid. Of these, nitric acid is particularly preferred. These nitrating reagents may be used singly or in combination of two or more kinds.

The nitration treatment in the homogeneous dispersion state is preferably carried out in the absence of a catalyst and using only a nitrating reagent to avoid use of extra additives, but if necessary, acid catalyst may be used.

There is no specific limitation on the acid catalysts, and any of acid catalysts may be used as far as they are liquid. Examples of the acid catalysts include inorganic strong acids such as sulfuric acid, hydrochloric acid and phosphoric acid; organic strong acids such as paratoluenesulfonic acid; Lewis acid such as boron trifluoride; inorganic weak acids such as carbonic acid and boric acid; and organic weak acids such as acetic acid, propionic acid and butyric acid. Of these, preferred is sulfuric acid from the viewpoints of catalytic activity and removal efficiency after the reaction.

The nitrating reagent is dissolved in water to constitute an aqueous solution in the homogeneous dispersion. As a matter of course, it is possible that the nitrating reagent is previously mixed with water to form an aqueous solution, which is then mixed with the petroleum heavy oil. The nitrating reagent is desirably contained in an amount of 15 to 60% by weight, preferably 20 to 50% by weight, more preferably 30 to 45% by weight, in the aqueous solution with water contained in the homogeneous dispersion.

When the amount of the nitrating reagent is less than 15% by weight, effective and rapid nitration reaction cannot be expected in some case. When the amount of the nitrating reagent exceeds 60% by weight, polymerization reaction by nitration proceeds too fast, whereby caking of the heavy oil sometimes occurs in the nitration stage, and in this case, desired nitrogen-containing isotropic pitch cannot be obtained.

The aqueous solution of the nitrating reagent is desirably contained in the homogeneous solution in an amount of 5 to 30 parts by weight, preferably 15 to 25 parts by weight, based on 100 parts by weight of the petroleum heavy oil.

In the process of the invention, it is important that the petroleum heavy oil is mixed with the nitrating reagent and water for dispersing or emulsifying the heavy oil to give a homogeneous dispersion or emulsion and the petroleum heavy oil is nitrated in the homogeneous dispersion or emulsion state. The homogeneous dispersion is particularly preferably a W/O homogeneous dispersion in which an aqueous phase composed of droplets of the nitrating reagent aqueous solution having a mean diameter of not more than 200 μm, preferably 100 to 1 μm, more preferably 5° to 1 μm, is dispersed in an oil phase containing the petroleum heavy oil.

In order to more effectively disperse or emulsify the aqueous phase and the oil phase in each other, an emulsifying agent such as a low boiling point silicone oil or a surface active agent may be added, if necessary, in combination with stirring by means of a homogenizing mixing machine or the like. In this case, the emulsifying agent is used in an amount of 1 to 4 parts by weight, preferably 2 to 3 parts by weight, based on 10 parts by weight of the petroleum heavy oil. Examples of the surface active agents particularly preferably used include nonionic surface active agents such as polyethylene glycol.

When the aqueous phase is dispersed or emulsified in the oil phase in the presence of the emulsifying agent such as a surface active agent or a low boiling point silicone oil, the homogenizing mixing machine is not necessarily used, and a stirring machine of ordinary type may be used, with the proviso that the petroleum heavy oil and the nitrating regent can be mixed to form a homogeneous dispersion or emulsion.

The nitration reaction can be carried out at a low reaction temperature of from room temperature (RT) to 80° C., preferably RT to 50° C., for a short reaction time of from 0.5 to 5 hours, preferably 0.5 to 1 hour.

When the reaction temperature is lower than room temperature, the nitration reaction is too retarded. On the other hand, when the reaction temperature is higher than 80° C., volatilization of the nitrating reagent and water may take place too vigorously to control the reaction. In the course of the nitration reaction, the temperature of the reaction system rises because heat of reaction is generated. Therefore, the system is preferably kept at a desirable reaction temperature of not higher than 80° C., by appropriate means such as circulation of cooling water.

In the nitration treatment in the invention, as described above, the petroleum heavy oil of liquid phase is sufficiently mixed with the nitrating reagent solution to give a homogeneous dispersion state or emulsion state in which the nitration reaction proceeds in the liquid-liquid phase. Therefore, nitration of the heavy oil is thoroughly carried out. In the nitration treatment in the invention, further, the nitration reaction can be satisfactorily performed even if no assistant such as acid catalyst is added or even at relatively low temperatures.

Accordingly, the petroleum heavy oil can be uniformly nitrated with inhibiting elimination of the light oil component contained in the heavy oil, and the subsequent polymerization by heat treatment can be effectively carried out.

(ii) Refining of nitrated heavy oil

In the present invention, the unreacted nitrating reagent and water contained in the nitrated heavy oil obtained by the nitration treatment (i) mentioned above are removed to refine the nitrated heavy oil.

For refining the nitrated heavy oil, any means can be adopted without specific limitation, with the proviso that only the nitrated heavy oil remains and the unreacted nitrating reagent and water are efficiently removed. For example, atmospheric distillation, vacuum distillation and centrifugal separation can be used singly or in combination. Of these, atmospheric distillation or vacuum distillation is particularly preferred from the viewpoint of removing efficiency of the unreacted nitrating reagent and water.

More specifically, the atmospheric distillation at a temperature of 80° to 150° C., preferably 100° to 120° C. can allow the unreacted nitrating reagent and water particularly easily and effectively fractionated and removed so as to obtain a refined nitrated heavy oil.

(iii) Heat treatment

In the present invention, the refined nitrated heavy oil obtained by the refining procedure mentioned above is then heat-treated to polymerize it, whereby crude nitrogen-containing isotropic pitch is prepared.

In the heat treatment of the refined nitrated heavy oil, the heating temperature is properly selected so that the polymerization reaction of the nitrated heavy oil proceeds effectively. The heat treatment is desirably carried out at a temperature of usually 250° to 400° C., preferably 300° to 350° C.

When the temperature for the heat treatment is lower than 250° C., a long period of time is generally required for obtaining a desired degree of polymerization. When the temperature is higher than 400° C., the polymerization reaction proceeds rapidly to sometimes bring about occurrence of coking.

(iv) Vacuum distillation Qf crude nitrogen-containing isotropic pitch

In the present invention, the crude nitrogen-containing isotropic pitch obtained by the heat treatment mentioned above is then subjected to vacuum distillation to remove light components and to adjust a softening point, a residual carbon ratio, etc. of the nitrogen-containing isotropic pitch.

The vacuum distillation conditions are properly selected so that desired removal efficiency of the light components, softening point and residual carbon ratio can be attained. In order to avoid further polymerization of the pitch to the utmost, the vacuum distillation is preferably carried out at a temperature lower than the temperature of the above-mentioned heat treatment.

Specifically, the vacuum distillation is desirably carried out at a temperature ranging from 200° to 350° C. and being lower than the temperature in the heat treatment previously carried out, under reduced pressure of not more than 10 Torr, preferably not more than 5 Torr, from the viewpoint of removal efficiency of the light components.

By variously altering the vacuum distillation conditions, the softening point, the residual carbon ratio, etc. of the nitrogen-containing isotropic pitch can be adjusted so as to allow the properties of the nitrogen-containing isotropic pitch to accord with the use of the pitch. Therefore, properties of isotropic pitch required for preparing various carbon materials can be beforehand designed, and a range of use of the isotropic pitch can be expected to be increased.

According to the invention, therefore, nitrogen-containing isotropic pitch of the invention not only having a quinoline-insoluble content (QI) of substantially zero and a sufficient content of nitrogen (N) but also having desired toluene-insoluble content (TI), softening point and residual carbon ratio can be prepared.

Such nitrogen-containing isotropic pitch of the invention is described below in more detail.

II. Nitrogen-containing isotropic pitch

The nitrogen-containing isotropic pitch of the invention has a quinoline-insoluble content (QI), a toluene-insoluble content (TI), a softening point, a residual carbon ratio and a nitrogen content (N), all specifically defined.

That is, the quinoline-insoluble content (QI) of the nitrogen-containing isotropic pitch of the invention is substantially zero. The expression "the quinoline-insoluble content (QI) is substantially zero" means that the quinoline-insoluble content in the pitch is zero, or it is not more than 0.1% by weight and only a trace amount of quinoline-insoluble is contained. In the case where the pitch has QI value of more than 0.1% by weight and of a significant figure, the pitch is often obtained by polymerizing the material having been ununiformly and insufficiently nitrated, and such pitch has inhomogeneous properties. On the other hand, the nitrogen-containing isotropic pitch having QI value of substantially zero indicates that the pitch is obtained from a material having been uniformly and sufficiently nitrated, and the pitch shows homogeneity and high quality even if its material has been highly polymerized so that the resulting pitch has a high softening point.

The nitrogen-containing isotropic pitch of the invention has a toluene-insoluble content (TI) of 30 to 70% by weight, preferably 40 to 60% by weight, and has a softening point, as measured by Mettler (ASTM D-3104), of 160° to 350° C.

There is correlation between the TI value and the softening point. As the TI value becomes low, the softening point also becomes low. When the TI value is less than 30% by weight and the softening point is lower than 160° C., the yield of product is lowered, although good fluidity can be obtained.

The softening point is appropriately selected from the above-mentioned range according to use of the pitch. For example, when the nitrogen-containing isotropic pitch of the invention is used as a material of fiber-reinforced resins (pitch for matrix), the pitch desirably has a relatively low softening point such as a softening point of not lower than 160° C. and lower than 200° C., from the viewpoints of fluidity and impregnating property.

When the nitrogen-containing isotropic pitch of the invention is used as pitch for carbon materials, the pitch desirably has an intermediate softening point, such as a softening point of 160° to 300° C., preferably 200° to 300° C.

Especially when the nitrogen-containing isotropic pitch of the invention is used as starting pitch for activated carbon fibers or carbon fibers, the pitch desirably has a relatively high softening point, such as a softening point of 200° to 350° C., preferably 210° to 350° C., from the viewpoint of yield of product. Of the nitrogen-containing isotropic pitches of the above-mentioned softening points, isotropic pitch having a softening point of not lower than 250° C. and never containing QI that becomes a heterogeneous component was unable to be obtained in the conventional processes.

The nitrogen-containing isotropic pitch of the invention has a residual carbon ratio, as measured by thermogravimetric analysis (TG) at 800° C. in inert atmosphere, of not less than 50% by weight, preferably 60 to 80% by weight. When the residual carbon ratio measured by thermogravimetric analysis (TG) at 800° C. in inert atmosphere is less than 50% by weight, the yields of various carbon materials from the pitch tend to be lowered.

The nitrogen-containing isotropic pitch of the invention has a nitrogen content, as measured by elemental analysis, of 0.5 to 3.5% by weight, preferably 1.0 to 3.0% by weight. The nitrogen-containing isotropic pitch having a nitrogen content of this range is a pitch which is obtained by using the material having been thoroughly nitrated in the nitration treatment, said nitrated material being able to be highly polymerized in the subsequent heat treatment to obtain the crude nitrogen-containing isotropic pitch. Such nitrogen-containing isotropic pitch having been thoroughly nitrated is highly heat-reactive, and therefore carbonization reaction of the pitch proceeds efficiently in the preparation of carbon materials. A nitrogen-containing isotropic pitch having a nitrogen content of more than 3.5% by weight is unfavorable, because caking has occurred in the course of the nitration treatment of the preparation of the pitch.

As described above, the nitrogen-containing isotropic pitch according to the invention has the above-defined QI value and nitrogen content, that is, nitration has been uniformly and thoroughly carried out in the preparation thereof, and hence the properties of the pitch are homogeneous.

Further, the nitrogen-containing isotropic pitch of the invention has the above-defined softening point, TI value and residual carbon ratio, and hence the pitch is a pitch of high quality obtained through uniform polymerization.

The nitrogen-containing isotropic pitch obtained by the process of the invention has a softening point (measured by Mettler (ASTM D-3104) of wide range, i.e., 160° to 350° C., and it can be used, for example, as a pitch having a softening point of 160° to 200° C., which is suitable for matrix, or a pitch having a softening point of 160° to 300° C., which is suitable for carbon materials, or a pitch having a softening point of 200° to 350° C., which is suitable for activated carbon fibers and carbon fibers. Particularly, the nitrogen-containing isotropic pitch of the invention can be obtained by highly polymerizing the material, and is able to have a softening point of not lower than 200° C. Any nitrogen-containing isotropic pitch having such a high softening point and homogeneous properties was unable to be accomplished by the conventional processes.

EFFECT OF THE INVENTION

As described hereinbefore, in the process for preparing nitrogen-containing pitch according to the invention, a petroleum heavy oil, a nitrating reagent and water are mixed to prepare a homogeneous dispersion, whereby the petroleum heavy oil is contacted with the nitrating reagent in the homogeneous dispersion state to prepare a crude nitrated heavy oil, and the crude nitrated heavy oil is then subjected to refining, thermal polymerization and vacuum distillation. That is, the process of the invention is so designed that the nitration is carried out efficiently and uniformly thereby to inhibit elimination of light oil components in the subsequent heat treatment procedure and to uniformly and highly polymerize the nitrated heavy oil. According to the process of the invention, a petroleum heavy oil containing a large amount of light oil components and being liquid at ordinary temperature, from which pitch has been hardly prepared conventionally, is used as a starting material for preparing pitch, and nitrogen-containing isotropic pitch of homogeneity and high quality having a desired softening point of from a low softening point to a high softening point can be prepared in a high yield, although such pitch was unable to be obtained so far.

In the process of the invention, moreover, because nitrogen-containing pitch having a desired softening point of from a low softening point to a high softening point can be prepared, there is an advantage that properties (e.g., softening point) of nitrogen-containing isotropic pitch required for preparing various impregnating materials and carbon materials can be previously designed.

The nitrogen-containing isotropic pitch according to the invention has the aforementioned QI value and nitrogen content, that is, nitration has been uniformly and thoroughly carried out in the preparation thereof, and hence the properties of the pitch are homogeneous. Further, the nitrogen-containing isotropic pitch of the invention has the aforementioned softening point, TI value and residual carbon ratio, and hence the pitch is a pitch of high quality obtained through uniform polymerization.

Furthermore, the nitrogen-containing isotropic pitch obtained by the process of the invention has a softening point (measured by Mettler (ASTM D-3104)) of wide range, i.e., 160° to 350° C., and for example, it can be favorably used not only as a pitch for matrix but also as a pitch for activated carbon fibers and carbon fibers, which is required to have a softening point of not lower than 200° C.

EXAMPLE

The present invention will be further described with reference to the following examples, but it should be construed that the invention is in no way limited to those examples. The data with regard to the following examples are set forth in Table 1.

Example 1

To a catalytically cracked residual oil (heavy oil) having a fa value of 0.6 and a viscosity at 50° C. of 32 cst, a 30 wt. % aqueous solution of nitric acid was little by little added in an amount of 20 parts by weight based on 100 parts by weight of the heavy oil over a period of 15 to 60 minutes, and they were forcibly stirred for 60 minutes using a homogenizing mixing machine (homomixer of Tokushukikakogyo K.K.) to emulsify and mix them. Thus, the starting materials became a homogeneous dispersion state. The homogeneous dispersion was stirred at room temperature for 1 hour to perform nitration reaction of the heavy oil. Thereafter, the nitrated heavy oil obtained was subjected to atmospheric distillation at 120° C. for 3 hours, to fractionate and remove the unreacted nitric acid and water.

Then, the thus treated product was heat-treated at 350° C. for 5 hours to perform polymerization, so as to obtain isotropic pitch having a softening point of 80° C. Subsequently, the isotropic pitch was subjected to vacuum distillation at 300° C. under 5 Torr to obtain nitrogen-containing isotropic pitch having the following properties in a yield of 28% by weight.

Softening point (ASTM D-3104): 200° C.

Quinoline-insoluble content (QI, ASTM D-2318): 0% by weight

Toluene-insoluble content (in accordance with Sumikin Processing Method): 30% by weight Residual carbon ratio (800° C., thermogravimetric analysis): 50% by weight Nitrogen content (elemental analysis, combustion method): 1.0% by weight

Example 2

To a catalytically cracked residual oil (heavy oil) having a fa value of 0.6 and a viscosity at 50° C. of 32 cst, a 40 wt. % aqueous solution of nitric acid was little by little added in an amount of 20 parts by weight based on 100 parts by weight of the heavy oil over a period of 15 to 60 minutes, and they were forcibly stirred for 60 minutes using a homogenizing mixing machine (homomixer of Tokushukikakogyo K.K.) to emulsify and mix them. Thus, the starting materials became a homogeneous dispersion state. The emulsion was stirred at room temperature for 1 hour to nitrate the heavy oil. Thereafter, the nitrated heavy oil obtained was subjected to atmospheric distillation at 120° C. for 3 hours, to fractionate and remove the unreacted nitric acid and water.

Then, the thus treated product was heat-treated at 350° C. for 3 hours to perform polymerization, so as to obtain isotropic pitch having a softening point of 90° C. Subsequently, the isotropic pitch was subjected to vacuum distillation at 300° C. under 5 Torr to obtain nitrogen-containing isotropic pitch having the following properties in a yield of 40% by weight.

Softening point (ASTM D-3104): 260° C.

Quinoline-insoluble content (QI, ASTM D-2318): 0% by weight

Toluene-insoluble content (in accordance with Sumikin Processing Method): 50% by weight Residual carbon ratio (800° C., thermogravimetric analysis): 62% by weight Nitrogen content (elemental analysis, combustion method): 2.0% by weight Example 3

To a catalytically cracked residual oil (heavy oil) having a fa value of 0.6 and a viscosity at 50° C. of 32 cst, a 57 wt. % aqueous solution of nitric acid was little by little added in an amount of 20 parts by weight based on 100 parts by weight of the heavy oil over a period of 15 to 60 minutes, and they were forcibly stirred for 60 minutes using a homogenizing mixing machine (homomixer of Tokushukikakogyo K.K.) to emulsify and mix them. Thus, the starting materials became an emulsion state. The emulsion was stirred at room temperature for 1 hour to nitrate the heavy oil. Thereafter, the nitrated heavy oil obtained was subjected to atmospheric distillation at 120° C. for 3 hours, to fractionate and remove the unreacted nitric acid and water.

Then, the thus treated product was heat-treated at 350° C. for 3 hours to perform polymerization, so as to obtain isotropic pitch having a softening point of 105° C. Subsequently, the isotropic pitch was subjected to vacuum distillation at 300° C. under 5 Torr to obtain nitrogen-containing isotropic pitch having the following properties in a yield of 56%.

Softening point (ASTM D-3104): 292° C.

Quinoline-insoluble content (QI, ASTM D-2318): 0% by weight

Toluene-insoluble content (in accordance with Sumikin Processing Method): 61% by weight Residual carbon ratio (800° C., thermogravimetric analysis): 67% by weight Nitrogen content (elemental analysis, combustion method): 2.6% by weight Example 4

The procedures of Example 1 were repeated except that 2 parts by weight of polyethylene glycol was added to 100 parts by weight of a mixture of a petroleum heavy oil and an aqueous solution of nitric acid and they were stirred for 60 minutes using an ordinary stirring machine (HEIDON Type 600G machine of Shinto Kagaku K.K.) to prepare a homogeneous dispersion. As a result, nitrogen-containing isotropic pitch having quality almost equal to that of the nitrogen-containing isotropic pitch of Example 1 was obtained.

Reference Example 1

To a catalytically cracked residual oil (heavy oil) having a fa value of 0.6 and a viscosity at 50° C. of 32 cst, a 10 wt. % aqueous solution of nitric acid was little by little added in an amount of 20 parts by weight based on 100 parts by weight of the heavy oil over a period of 15 to 60 minutes, and they were forcibly stirred for 60 minutes using a homogenizing mixing machine (homomixer of Tokushukikakogyo K.K.) to emulsify and mix them. Thus, the starting materials became an emulsion state. The emulsion was stirred at room temperature for 1 hour to nitrate the heavy oil. Thereafter, the nitrated heavy oil obtained was subjected to atmospheric distillation at 120° C. for 3 hours, to fractionate and remove the unreacted nitric acid and water.

Then, the thus treated product was heat-treated at 350° C. for 6 hours. However, no pitch was obtained because the nitration reaction did not proceed satisfactorily. The liquid given after the heat treatment had a nitrogen content of 0.4% by weight.

Reference Example 2

To a catalytically cracked residual oil (heavy oil) having a fa value of 0.6 and a viscosity at 50° C. of 32 cst, a 65 wt. % aqueous solution of nitric acid was little by little added in an amount of 20 parts by weight based on 100 parts by weight of the heavy oil over a period of 15 to 60 minutes, and they were forcibly stirred for 60 minutes using a homogenizing mixing machine (homomixer of Tokushukikakogyo K.K.) to emulsify and mix them. Thus, the starting materials became an emulsion state. The emulsion was stirred at room temperature for 1 hour to nitrate the heavy oil. Thereafter, the nitrated heavy oil obtained was subjected to atmospheric distillation at 120° C. for 3 hours, to fractionate and remove the unreacted nitric acid and water.

Then, the thus treated product was heat-treated at 350° C. for 3 hours. However, the nitration reaction proceeded too fast at the above nitration treatment. As a result, a solid having a softening point of not lower than 350° C. and a toluene-insoluble content of 74% by weight was produced, and the solid did not show fluidity required for molding. The solid had a nitrogen content of 3.6% by weight.

Comparative Example 1

The petroleum heavy oil used in Example 1 was heat-treated at 300° C. without performing a nitric acid treatment. As a result, most of the heavy oil component escaped out from the heat-treating apparatus, and no pitch was obtained.

Comparative Example 2

The procedures of Example 1 were repeated except that the petroleum heavy oil and a 40 wt. % aqueous solution of nitric acid were mixed in a shaker at room temperature for 60 minutes to give a heterogeneous suspension. As a result, the nitration reaction proceeded ununiformly, and heterogeneous pitch having QI content of 7% by weight and a low softening point (190° C.) was obtained in a yield of 10% by weight.

TABLE 1

| | Starting oil | | Nitric acid treatment | | | Heat treatment | | Properties of pitch | | | | | |
|---|---|---|---|---|---|---|---|---|---|---|---|---|---|
| | fa | Viscosity (cst) | Concentration of nitric acid (%) | Temperature (°C.) | Time (hr) | Temperature (°C.) | Time (hr) | Yield (%) | SP (°C.) | QI (%) | TI (%) | Residual carbon ratio (%) | Nitrogen content (%) |
| Ref. Ex. 1 | 0.6 | 32 | 10 | RT | 1.0 | 350 | 6.0 | No pitch was obtainted because nitration reaction did not proceed. | | | | | 0.4 |
| Ex. 1 | 0.6 | 32 | 30 | RT | 1.0 | 350 | 5.0 | 28 | 200 | 0 | 30 | 50 | 1.0 |
| Ex. 2 | 0.6 | 32 | 40 | RT | 1.0 | 350 | 3.0 | 40 | 260 | 0 | 50 | 62 | 2.0 |
| Ex. 3 | 0.6 | 32 | 57 | RT | 1.0 | 350 | 3.0 | 56 | 292 | 0 | 61 | 67 | 2.6 |
| Ref. Ex. 2 | 0.6 | 32 | 65 | RT | 1.0 | 350 | 3.0 | 350 | No pitch was obtained because caking took place by nitration reaction. | | | 74 | 3.6 |

What is claimed is:

1. A process for preparing nitrogen-containing isotropic pitch comprising the steps of:

preparing a homogeneous dispersion containing a petroleum heavy oil, a nitrating reagent and water, said nitrating reagent comprising at least one selected from the group consisting of nitric acid, organic nitric acid esters and nitrous acid;

contacting the petroleum oil with the nitrating reagent in the homogeneous dispersion state to obtain a crude nitrated heavy oil;

removing water and the unreacted nitrating reagent contained in the crude nitrated heavy oil to prepare a refined nitrated heavy oil;

heating the refined nitrated heavy oil to polymerize the heavy oil so as to prepare a crude nitrogen-containing isotropic pitch; and vacuum-distilling the crude nitrogen-containing isotropic pitch to remove light components produced by the polymerization, thereby adjusting a softening point and a residual carbon ratio of the nitrogen-containing isotropic pitch.

2. The process for preparing nitrogen-containing isotropic pitch as claimed in claim 1, wherein the petroleum heavy oil has an aromatic carbon ratio fa of not more than 0.8, contains light oil components and is liquid at ordinary temperature.

3. The process for preparing nitrogen-containing isotropic pitch as claimed in claim 1 or claim 2, wherein the nitrating reagent constitutes an aqueous solution with the water contained in the homogeneous dispersion and is contained in the aqueous solution in an amount of 15 to 60% by weight.

4. Nitrogen-containing isotropic pitch having a quinoline-insoluble content (QI) of substantially zero, a toluene-insoluble content (TI) of 30 to 70% by weight, a softening point, as measured by Mettler (ATM D-3104), of 160° to 350° C., a residual carbon ratio, as measured by thermogravimetric analysis (TG) at 800° C. in inert atmosphere, of not less than 50% by weight, and a nitrogen content, as measured by elemental analysis, of 0.5 to 3.5% by weight.

5. The nitrogen-containing isotropic pitch as claimed in claim 4, wherein the softening point is in the range of 160° to 200° C.

6. The nitrogen-containing isotropic pitch as claimed in claim 4, wherein the softening point is in the range of 200° to 350° C.

7. The nitrogen-containing isotropic pitch as claimed in claim 4, wherein the softening point is in the range of 250° to 350° C.

* * * * *